United States Patent [19]

Evans et al.

[11] 3,960,616

[45] June 1, 1976

[54] RARE EARTH METAL TREATED COLD ROLLED, NON-ORIENTED SILICON STEEL AND METHOD OF MAKING IT

[75] Inventors: James D. Evans, Middletown, Ohio; William R. Long, Jr., Renfrew, Pa.

[73] Assignee: Armco Steel Corporation, Cincinnati, Ohio

[22] Filed: June 19, 1975

[21] Appl. No.: 588,295

[52] U.S. Cl. ..... 148/111; 148/31.55; 148/110; 148/112; 75/123 E; 75/123 L; 75/129

[51] Int. Cl.[2] ..... H01F 1/04

[58] Field of Search ..... 148/111, 112, 110, 31.55; 75/123 L, 123 E, 129

[56] References Cited

UNITED STATES PATENTS

| | | | |
|---|---|---|---|
| 3,305,354 | 2/1967 | Boni et al. | 75/129 |
| 3,666,452 | 5/1972 | Korchynsky et al. | 75/123 E |
| 3,867,211 | 2/1975 | Easton | 148/31.55 |

*Primary Examiner*—Walter R. Satterfield
*Attorney, Agent, or Firm*—Melville, Strasser, Foster & Hoffman

[57] ABSTRACT

A melt for cold rolled, non-oriented silicon steel is deoxidized and thereafter treated with mischmetal or a mischmetal alloy to desulfurize the melt to 0.012% by weight sulfur or less without the formation of a polluting smoke. The deoxidation is carried out to the extent that, and the mischmetal is added in an amount such that, the melt composition, has a total cerium content of up to about 400 ppm. and preferably from about 75 to about 250 ppm.

15 Claims, No Drawings

RARE EARTH METAL TREATED COLD ROLLED, NON-ORIENTED SILICON STEEL AND METHOD OF MAKING IT

BACKGROUND OF THE INVENTION

1. Field of the Invention

The present invention is directed to the treatment with rare earth metal of refined steel melts for cold rolled, non-oriented silicon steel for purposes of desulfurization without the production of polluting smoke.

2. Description of the Prior Art

In a typical prior art manufacture of a cold rolled, non-oriented silicon steel, a melt is produced in an electric arc furnace or other suitable type of furnace. Typically, the melt is deoxidized either by furnace additions, tap additions or additions in any number of reladle operations. Calcium silicon has been determined to be an excellent desulfurizer and has hitherto been added to desulfurize the killed melt.

The calcium reacts with sulfur and floats to the surface of the silicon steel. This reaction produces objectionably large amounts of smoke comprising fine lime powder. Upon desulfurization, the melt may be argon bubbled or degassed (or both) to improve the cleanliness of the melt and to achieve temperature uniformity throughout the melt.

In recent years stringent pollution control laws have been enacted. In order to have their melt shops meet these laws, prior art workers have turned to the use of expensive pollution control equipment such as fume hoods and bag house systems to control the smoke produced by the calcium-silicon desulfurizing step.

The present invention is based upon the use of rare earth metals and rare earth metal alloys as desulfurizers. Rare earth metal sulfides oxides and oxysulfides are formed in the melt and float up to the slag. The resulting rare earth metal compounds are insoluble and do not volatilize and form smoke.

Heretofore, rare earth metals have been used in high-strength, low alloy steels to control sulfide morphology in the solid state. The rare earth metals form small sulfide inclusions rather than sulfide stringers in the high-strength, low allow steels. Such small inclusions can be detrimental, however, in electrical steels wherein they interfere with the magnetic properties of such steels. It has been found that if the rare earth metal content (based upon the cerium content) in the melt, is maintained at a level of up to about 400 ppm., and preferably from about 75 to about 250 ppm., the final product will demonstrate both mechanical and magnetic characteristics at least equivalent to those of the typical cold rolled, non-oriented silicon steel desulfurized with calcium silicon.

SUMMARY OF THE INVENTION

In accordance with the present invention a melt for cold rolled, non-oriented silicon steel is refined, including both deoxidation and desulfurization. The deoxidation is accomplished in a conventional manner utilizing ferrosilicon and aluminum as deoxidizing agents. Desulfurization to a sulfur content of about 0.012% by weight or less is accomplished by adding to the melt mischmetal or a mischmetal alloy such as a mischmetal-silicide alloy or a mischmetal-aluminum alloy, or cerium metal.

Deoxidation is carried out to such an extent that, and the mischmetal or mischmetal alloy is added in an amount such that, the melt composition has a total cerium content of not more than 400 ppm. and preferably from about 75 to about 250 ppm.

The refining of the melt, including the deoxidation and desulfurization, can be accomplished using one or more ladles by a variety of procedures including argon stirring, vacuum degassing or the like. The refined melt composition is thereafter transformed by suitable practices to a cold rolled, non-oriented silicon steel final product. The final product may take the form of a semi-process cold rolled, non-oriented silicon steel or a fully processed cold rolled, non-oriented silicon steel, and should have a cerium content of up to about 400 ppm.

DESCRIPTION OF THE PREFERRED EMBODIMENTS

As used herein and in the claims, the term "cold rolled, non-oriented silicon steel" refers to iron-silicon-aluminum alloys or iron-silicon alloys with trace aluminum, the refined melt compositions of which contain in percent by weight from about 0.5 to about 4% (and preferably from about 1.5 to about 3.2%) silicon, up to about 0.8% (and preferably from about 0.2 to about 0.5%) aluminum, from about 0.05 to about 0.5% (and preferably from about 0.15 to about 0.45%) manganese and about 0.012% maximum (and preferably from about 0.004 to about 0.010%) sulfur, about 0.1% maximum carbon, the balance being iron and those impurities incidental to the mode of manufacture. The cold rolled, non-oriented silicon steel may be prepared and sold as a final product in either a semi-processed form or a fully processed form as will be developed hereinafter. The final product will have essentially the same composition given with respect to the melt above with the exception that in the semi-processed form the carbon content will have been reduced to less than about 0.010% and preferably to less than about 0.008% and in the fully processed form, the carbon content will be less than about 0.005% and preferably less than about 0.003%. Both the semi-processed and fully processed final products will have a critical rare earth content, calculated as cerium, as will be developed hereinafter. For the best quality and to assure consistant high quality the final product should have a rare earth content calculated as cerium of up to 400 ppm. and preferably from 75 to 250 ppm. In the ingot the rare earth oxides, sulfides and oxysulfides may tend to rise so that final produce samples from the bottom of the ingot may have a lesser rare earth content measured as cerium than final product samples from the upper end of the same ingot. This is particularly true at higher rare earth levels because of the solubility product - temperature relationship.

The melt may be prepared in any suitable melting furnace, as for example, in an electric arc furnace basic oxygen furnace or open hearth furnace. Thereafter, the melt is refined including deoxidation, desulfurization and the addition of desired elements to achieve the final desired chemistry. Argon stirring, vacuum degassing or both may be practiced to improve the cleanliness of the melt and the temperature uniformity within the melt.

In accordance with the present invention, desulfurization is accomplished through the use of mischmetal, mischmetal silicide, mischmetal-aluminum alloy or cerium metal. While other singular rare earch metals may be used, at present their use is not economically feasible. As used herein and in the claims, the term mischmetal refers to a mixture of rare-earth elements (atomic number 57 through 71) in metallic form. In general, mischmetal contains about 50% cerium, the remainder being principally lanthanum and neodymium. Mischmetal, mischmetal silicide, mischmetal-aluminum alloy and cerium metal are well known and commercially available.

The refining step can be accomplished by a number of procedures. An open heat can be killed in a furnace prior to tapping or tapped into a ladle for deoxidation and alloy additions using one or more ladles, all as is well known in the art.

Thereafter, the molten metal in the ladle may optionally be argon stirred and/or vacuum degassed to assist in cleansing the melt and to make the temperature more uniform throughout the body of molten metal.

Mischmetal, mischmetal silicide, mischmetal-aluminum alloy or cerium metal may be added for purposes of desulfurization during the tapping, reladling, argon stirring or vacuum degassing procedures. The most economical results are obtained by achieving maximum deoxidation prior to the addition of the rare earth metal or rare earth metal compound. After the addition of the rare earth metal or rare earth metal compound reoxidation of the melt should be minimized.

Various papers have been given regarding the thermodynamics of rare earth metal or rare earth metal compound additions including the reaction products and the amount of desulfurization to be expected. For example, attention is called to: Journal of Metals, May 1974, pp. 14–23 and Metals and Materials, October 1974, pp. 452–457. Since refining involves the formation of reaction products in the melt such as mischmetal oxides, mischmetal sulfides and mischmetal oxysulfides, time must be allotted for the flotation of these products to obtain optimum magnetic properties.

An advantage of rare earth metal or rare earth metal compound desulfurization is that neither the rare earth metal or compound thereof, nor reaction products therefrom, volatilize and form smoke. In any appropriate refining-desulfurization procedure used (including one or more ladles, argon stirring and/or vacuum degassing), deoxidation is conducted to the extent that, and an amount of mischmetal, mischmetal alloy or cerium metal is added such that, in the final melt the total cerium in solution or combined with sulfur, oxygen and other elements is not more than about 400 ppm. and preferably is from about 75 to about 250 ppm. When this is true, the magnetic properties of the resulting cold rolled, non-oriented silicon steel are at least comparable to those of cold rolled, non-oriented silicon steel conventionally desulfurized with calcium silicon. The above is stated in terms of cerium rather than total rare earths or rare earth compounds because, at the present time, analytical methods are more accurate for cerium.

In recent times, in the manufacture of cold rolled, non-oriented silicon steel, sulfur control has been the most important chemical factor in the melting and refining procedures. For all grades, a maximum of 0.008% sulfur was considered necessary. For the best quality grades, a maximum of 0.005% sulfur was required. When sulfur levels were above these values, the quality of the cold rolled, non-oriented silicon steel was always poorer than desired. However, in the development of the present invention, when these sulfur levels were attained with rare earth desulfurized heats as taught herein, the magnetic quality of the final product has been poorer than for equivalent calcium silicon desulfurized heats. High cerium residuals are experienced when low sulfurs are obtained.

It is a discovery of the present invention that poorer core loss values are associated with high residual cerium heats. It has now been found that sulfur values above those limits heretofore believed required in the prior art practice can produce good quality in rare earth-desulfurized cold rolled, non-oriented silicon steel. It has been determined in the practice of the present invention that, for example, the best quality in semi-processed and fully processed grades of cold rolled, non-oriented silicon steel are achieved when the sulfur content lies in the range of about 0.004% to about 0.010% by weight.

From the above it has become evident that in the rare earth desulfurization of cold rolled, non-oriented silicon steel the residual cerium has become the most important chemical variable. It is also recognized that the effects of both the cerium and the sulfur contents on the final magnetic quality of the cold rolled, non-oriented silicon steel are interrelated.

After the melting and refining-desulfurization steps are accomplished, the melt may be appropriately processed to form a semi-processed cold rolled, non-oriented silicon steel or a fully processed, cold rolled, non-oriented silicon steel. While such processing does not constitute a part of the present invention, an exemplary routing for a semi-processed product would include hot rolling, annealing, pickling, cold rolling and subjecting the s teel to a decarburizing anneal. The customer will practice a quality anneal.

For fully processed cold rolled, non-oriented silicon steel the procedure set forth above for a semi-processed product may be followed. In this instance, however, the silicon steel is subjected to a quality anneal at the mill. As used herein, the term "quality anneal" refers to that anneal in which the final desired magnetic qualities are developed.

EXAMPLE 1

A heat of 2% silicon steel was melted in an electric furnace to 0.024%C and 0.018%S, and tapped into a ladle into which some ferro-silicon, ferro-manganese silicon and aluminum were added for deoxidation. The first ladle was then teemed into a second ladle where more ferro-silicon was added for alloying purposes. Then the second ladle was subjected to a vacuum treatment for stirring and final alloy treatment. In this operation aluminum and rare earth silicide were added for the final deoxidation and desulfurization treatment. Sufficient time was allowed after the aluminum and rare earth silicide addition for at least one complete volume exchange of the metal in the ladle. This time is necessary for adequate flotation of inclusions formed in the final deoxidation and desulfurization process. Finally, the heat was teemed at a temperature of about 2820°F into ingots having a chemistry of 0.024%C, 0.26%Mn, 0.010%S, 2.04%Si, 0.27%Al, 0.0038%Ti, 0.015% (150ppm)Ce, 0.009%$N_2$, and < 20ppm $O_2$, and residual elements typical for a mainly scrap iron cold charge melt practice.

The ingots were subsequently slab rolled to 6 inches, reheated to about 2100°F and hot rolled. The hot rolled coil was annealed at about 1850°F. and pickled prior to cold rolling in one stage to about 0.024 inches. After cold reduction, the coil was strip normalized at about 1525°F in a wet hydrogen containing atmosphere to recrystallize the grain structure and remove carbon to about 0.010% or less. Finally, samples were obtained and sheared into Epstein strips; half parallel and half transverse to the rolling direction. These semi-processed strips were then given a batch Quality Anneal at 1550°F for 1 hour in a 90% $N_2$—10% $H_2$ atmosphere having about a 110°F dew point.

Resultant magnetic quality which is an average of front and back ends of all the coils from the heat was: core loss at 15 kilogauss and 60Hz of 1.92 watts/lb. for an average gage of 0.024 inches. The permeability at 7,000 gauss averaged 15,500.

EXAMPLE 2

Another heat of 2% silicon steel was melted in an electric furnace to 0.026%C and .018%S, and tapped into a ladle into which ferro-silicon, ferro-manganese silicon and some aluminum were added for deoxidation and alloying purposes. This ladle was then argon stirred for 6 minutes for mixing. Subsequently, the ladle was subjected to a vacuum treatment as in Example 1 where aluminum and rare earth silicide were added. Again, time was allowed after this addition for flotation of inclusions, and the heat was teemed at a temperature of about 2810°F into ingots having a chemistry of 0.025%C, 0.26%Mn, 0.007%S, 2.02%Si, 0.27%Al, 0.0036%Ti, 0.018% (180ppm.)Ce, 0.008%$N_2$ and < 0.002%$O_2$; residuals were typical for a mainly scrap iron, cold charge melt practice.

Processing from the ingot was essentially the same as in Example 1. Core loss after a similar batch quality anneal averaged 1.98 watts/lb. for 0.024 inch thickness at 15 kilogauss and 60 Hz and the 7,000 gauss permeability averaged 15,600.

EXAMPLE 3

A heat of 3% silicon steel was melted in an electric furnace to 0.026%C and 0.016%S, and tapped into a ladle into which ferro-manganese silicon, ferro-silicon and aluminum were added for deoxidation. This ladle was 0.008%S, 3.03%Si, teemed into a second ladle where more ferro-silicon was added for alloying. The second ladle was stirred with Argon gas during the reladling operation. Metal in this second ladle was subjected to a vacuum treatment for final alloy additions and for final deoxidation and desulfurization with aluminum and rare earth silicide. About 15 minutes was allowed after the rare earth silicide addition to allow for inclusion flotation prior to teeming into ingots at about 2800°F. Chemical composition of the ingots was 0.029%C, 28%Mn, 0.008%S, 3.03%Si, 0.31%Al, 0.013%(130ppm)Ce, 0.008%$N_2$, < 20ppm $O_2$ and residuals typical of cold mainly scrap charge melt practice. The ingots were slab rolled to 6 inches, reheated at about 2100°F, hot rolled, annealed at about 1675°F, pickled and cold rolled in one stage to about 0.018 inch thickness. The cold rolled strip was then tandem annealed. The first part of the anneal was a normalizing treatment at about 1500°F in a wet hydrogen containing atmosphere and the second part of the anneal was a strip quality anneal at 1900°F in a semi-dry hydrogen containing atmosphere. The sum total of this tandem anneal, reduced the carbon content to < 0.005% and allowed grain growth for attainment of final magnetic properties. Average core loss at 15 kilogauss and 60Hz for front and back end Epstein samples from all coils in this heat, tested as sheared on a half parallel, half transverse basis, was 1.59 watts/lb. at an average thickness of 0.0182 inch. Average core loss at 10 kilogauss and 60Hz was 0.690 watts/lb.

Modifications may be made in the invention without departing from the spirit of it.

The embodiments of the invention in which an exclusive property or privilege is claimed are defined as follows:

1. A refined melt composition for a cold rolled, non-oriented silicon steel comprising in per cent by weight from about 0.5 to about 4% silicon, up to about 0.8% aluminum, from about 0.05 to about 0.5% manganese, about 0.012% maximum sulfur, up to about 0.1% maximum carbon and a positive amount of up to about 400 ppm. cerium, the balance being iron.

2. The melt composition claimed in claim 1 wherein said silicon content is from about 1.5 to about 3.2%, said aluminum content is from about 0.2 to about 0.5%, said manganese content is from about 0.15 to about 0.45% and said sulfur content is from about 0.004 to about 0.010%.

3. The melt composition claimed in claim 1 wherein said cerium is from about 75 to about 250 ppm.

4. The melt composition claimed in claim 2 wherein said cerium is from about 75 to about 250 ppm.

5. A cold rolled, non-oriented, semi-processed silicon steel having a composition comprising in percent by weight from about 0.5 to about 4% silicon, up to about 0.8% aluminum, from about 0.05 to about 0.5% manganese, about 0.012% maximum sulfur, less than about 0.010% carbon and up to about 400 ppm. cerium, the balance being iron.

6. The silicon steel claimed in claim 5 wherein said silicon content is from about 1.5 to about 3.2%, said aluminum content is from about 0.2 to about 0.5%, said manganese content is from about 0.15 to about 0.45%, said carbon content is less than about 0.008% and said sulfur content is from about 0.004 to about 0.010%.

7. The silicon steel claimed in claim 5 wherein said cerium is from about 75 to about 250 ppm.

8. The silicon steel claimed in claim 6 wherein said cerium is from about 75 to about 250 ppm.

9. A cold rolled, non-oriented, fully processed silicon steel having a composition comprising in percent by weight from about 0.5 to about 4% silicon, up to about 0.8% aluminum, from about 0.05 to about 0.5% manganese, about 0.012% maximum sulfur, less than about 0.005% carbon and up to about 400 ppm. cerium, the balance being iron.

10. The silicon steel claimed in claim 9 wherein said silicon content is from about 1.5 to about 3.2%, said aluminum content is from about 0.2 to about 0.5%, said manganese content is from about 0.15 to about 0.45%, said carbon content is less than about 0.003% and said sulfur content is from about 0.004 to about 0.010%.

11. The silicon steel claimed in claim 9 wherein said cerium is from about 75 to about 250 ppm.

12. The silicon steel claimed in claim 10 wherein said cerium is from about 75 to about 250 ppm.

13. A method of preparing a refined silicon steel melt for semi-processed and fully processed cold rolled, non-oriented silicon steels comprising the steps of melting a heat of silicon steel tapping said melt into a ladle, adding ferro-silicon, ferro-manganese silicon and aluminum for deoxidizing and alloying purposes, mixing said melt by argon stirring, subjecting said melt to a vacuum degassing treatment, adding aluminum and a substance chosen from the class consisting of a rare earth metal and a rare earth metal compound for final deoxidation and desulfurization of said melt, continuing said vacuum degassing treatment for a period of time sufficient for at least one complete volume exchange within said ladle to permit adequate flotation of inclusions formed during said final deoxidation and desulfurization, said refined melt comprising in percent by weight from about 0.5 to about 4% silicon, up to about 0.8% aluminum, from about 0.5 to about 4% silicon, up to about 0.8% aluminum, from about 0.05 to about 0.5% manganese, about 0.012% maximum sulfur, up to about 0.1% maximum carbon and up to about 400 ppm. cerium, the balance being iron.

14. A method of preparing a refined silicon steel melt for semi-processed and fully processed cold rolled, non-oriented silicon steels comprising the steps of melting a heat of silicon steel, tapping said melt into a first ladle, adding ferro-silicon, ferro-manganese silicon and aluminum for deoxidation purposes, teeming said first ladle into a second ladle, adding ferro-silicon to said second ladle for alloying purposes, subjecting said second ladle to a vacuum degassing treatment, adding aluminum and a substance chosen from the class consisting of a rare earth metal and a rare earth metal compound for final deoxidation and desulfurization of said melt, continuing said vacuum degassing treatment for a period of time sufficient for at least one complete volume exchange within said ladle to permit adequate flotation of inclusions formed during said final deoxidation and desulfurization, said refined melt comprising in percent by weight from about 0.5 to about 4% silicon, up to about 0.8% aluminum, from about 0.05 to about 0.5% manganese, about 0.012% maximum sulfur, up to about 0.1% maximum carbon and up to about 400 ppm. cerium, the balance being iron.

15. The method claimed in claim 14 including the step of stirring said melt in said second ladle with argon gas during the teeming thereof from said first ladle.

* * * * *